US005966585A

United States Patent [19]

Sue

[11] Patent Number: 5,966,585

[45] Date of Patent: Oct. 12, 1999

[54] TITANIUM CARBIDE/TUNGSTEN BORIDE COATINGS

[75] Inventor: Jiinjen Albert Sue, Indianapolis, Ind.

[73] Assignee: Union Carbide Coatings Service Corporation, Danbury, Conn.

[21] Appl. No.: 06/651,690

[22] Filed: Sep. 18, 1984

[51] Int. Cl.[6] ..... B22F 7/08; C22C 5/00

[52] U.S. Cl. ..... 428/555; 75/254; 428/556

[58] Field of Search ..... 428/457, 554, 428/555, 556; 75/254

[56] References Cited

U.S. PATENT DOCUMENTS

| | | | |
|---|---|---|---|
| 3,916,506 | 11/1975 | Wolf | 428/148 X |
| 3,975,568 | 8/1976 | Rudness | 428/331 X |
| 4,019,873 | 4/1977 | Reiter | 428/457 X |

*Primary Examiner*—Peter A. Nelson
*Attorney, Agent, or Firm*—Cornelius F. O'Brien

[57] ABSTRACT

A new family of titanium carbide/tungsten boride coatings having excellent wear and corrosion resistance is disclosed. The coatings comprise hard, ultrafine, titanium carbide particles and tungsten boride precipitates dispersed in a metal matrix, the two phases constituting from about 30 to about 80 volume percent of the coating, the balance being metal matrix. The metal matrix contains at least one metal selected from a group consisting of nickel, cobalt and iron. The coatings may be prepared by a process which comprises depositing a mechanically blended powder mixture composed of separate components including a first component containing tungsten carbide and a second component containing boron and at least one metal selected from the group consisting of nickel, cobalt and iron, the powder mixture including titanium in the first or second component or in a separate third component, at least one of the first, second or third components having a melting point below about 1200° C., and then heat treating the as-deposited coating. The heating treatment effects a diffusion reaction between the deposited elements resulting in the formation of ultrafine titanium carbide particles and tungsten boride precipitates dispersed in a metal matrix. The coating can be deposited onto the substrate using any of the known deposition techniques.

16 Claims, 2 Drawing Sheets

TITANIUM CARBIDE/TUNGSTEN BORIDE COATINGS

RELATED APPLICATIONS

Copending application Ser. No. 651,789, filed on even date herewith and assigned to the common assignee hereof discloses subject matter which is related to the present invention.

BACKGROUND OF THE INVENTION

1. Field of the Invention

The present invention relates to titanium carbide/tungsten boride coatings having excellent corrosion and wear resistance and to a process for preparing such coatings. More particularly, the invention relates to hard, dense, low-porosity, corrosion and wear resistant coatings containing ultrafine particles of titanium carbide and tungsten boride precipitates dispersed in a metallic matrix. The invention also relates to a process for preparing such coatings in situ by thermal spray and diffusion reaction techniques.

Throughout the specification, reference will be made to plasma arc spraying and detonation gun (D-Gun) techniques for depositing coatings. Typical detonation gun techniques are disclosed in U.S. Pat. Nos. 2,714,563 and 2,950,867. Plasma arc spray techniques are disclosed in U.S. Pat. Nos. 2,858,411 and 3,016,447. Other thermal spray techniques are also known, for example, so-called "high velocity" plasma and "hypersonic" combustion spray processes, as well as the various flame spray processes. Heat treatment of the coatings is necessary and may be done after deposition in a vacuum or inert gas furnace or by electron beam, laser beam, induction heating, transferred plasma arc or other technique. Alternative deposition techniques such as slurries, filled fabrics or electrophoresis, followed by heat treatment, are also known. Still other methods include simultaneous deposition and fusion utilizing plasma transferred arc, laser or electron beam surface fusion with or without post deposition heat treatment.

2. Background Art

Cutting tools are usually made of tungsten carbide-cobalt alloys. These alloys are extremely hard, strong and tough and exhibit excellent wear properties under most conditions of use. However, a problem with these alloys has been that tungsten carbide is subject to oxidation at temperatures above about 540° C. When operated at these elevated temperatures for any sustained period, cutting tools made of these alloys loose their wear properties and frequently crack, spall or chip.

Chemical vapor deposition techniques have been used to improve the wear properties and oxidation resistance of tungsten carbide-cobalt cutting tools by depositing a thin layer of titanium diboride ($TiB_2$) on the surface of the parts. Due to interactions between $TiB_2$ and WC/Co at elevated temperatures, a thin film which is less than about 30 microns thick, is formed on the surface of the cutting tools which contains CoWB and TiC compounds. Titanium carbide has a higher oxidation resistance than tungsten carbide and is more stable. Consequently, the formation of a film containing these compounds increases the wear resistance of the cutting tools.

Vapor deposited films containing CoWB and TiC are furthermore limited to use with only a few substrates, particularly tungsten carbide-cobalt alloys. It would be advantageous therefore to develop TiC/WCoB coatings which can be applied to a variety of substrate materials.

SUMMARY OF THE INVENTION

According to the present invention, there is provided a family of titanium carbide/tungsten boride coatings having excellent abrasion and corrosion wear resistance and which are compatible with a variety of substrate materials. These coatings comprise hard, ultrafine, titanium carbide particles and tungsten boride precipitates dispersed in a metallic matrix, the two phases constituting from about 30 to about 90 volume percent of the coating. The coating has a hardness of about 700 to 1200 $DPH_{300}$ (HV.3) and is capable of withstanding temperatures up to about 800° C.

The coatings of the present invention may be prepared by a process which comprises depositing onto a substrate a mechanically blended powder mixture composed of separate components including at least a first component containing tungsten carbide and a second component containing boron and at least one metal selected from the group consisting of nickel, cobalt and iron, said powder mixture including titanium in the first or second component or in a separate third component, at least one of the first, second or third components having a melting point below about 1200° C., and then heat treating the as-deposited coating. The heat treatment effects a fusion reaction between the deposited elements resulting in the formation of ultrafine particles of titanium carbide and tungsten boride dispersed in a metallic matrix. The coating can be deposited onto the substrate using any of the known deposition techniques above or a similar technique.

In a preferred embodiment of the present invention, coatings containing titanium carbide and tungsten-boride precipitates are applied to various substrate materials.

DESCRIPTION OF THE PREFERRED EMBODIMENTS

Figure 1:
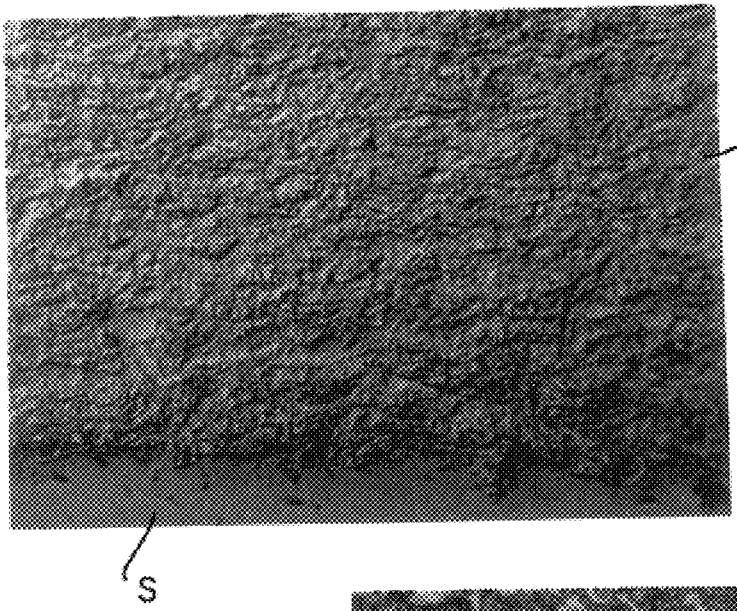
FIG. 1 is a photomicrograph taken at a magnification of 220× showing a typical as-deposited coating according to the present invention.

The coatings of the present invention are preferably applied to a substrate using thermal spray processes. In one such process, i.e. plasma spraying, an electric arc is established between a non-consumable electrode and a second non-consumable electrode spaced therefrom. A gas is passed in contact with the non-consumable electrode such that it contains the arc. The arc-containing gas is constricted by a nozzle and results in a high thermal content effluent. The powdered coating material is injected into the high thermal content effluent and is deposited onto the surface to be coated. This process and plasma arc torch used therein are described in U.S. Pat. No. 2,858,411. The plasma spray process produces a deposited coating which is sound, dense, and adherent to the substrate. The deposited coating also consists of irregularly shaped microscopic splats or leaves which are interlocked and mechanically bonded to one another and also to the substrate.

Another method of applying the coatings to a substrate is by detonation gun (D-Gun) deposition. A typical D-Gun consists essentially of a water-cooled barrel which is several feet long with an inside diameter of about one inch. In operation, a mixture of oxygen and a fuel gas, eg. acetylene, in a specified ratio (usually about 1:1) is feed into the barrel along with a charge of powder to be coated. The gas is then ignited and the detonation wave accelerates the powder to about 2400 ft./sec. (730 m/sec.) while heating the powder close to or above its melting point. After the powder exits the barrel, a pulse of nitrogen purges the barrel and readies the system for the next detonation. The cycle is then repeated many times a second.

The D-Gun deposits a circle of coating on the substrate with each detonation. The circles of coating are about one inch (25 mm) in diameter and a few ten thousandths of an inch (i.e., several microns) thick. Each circle of coating is composed of many overlapping microscopic splats corresponding to the individual powder particles. The overlapping splats are interlocked and bonded to each other and to the substrate without substantial alloying at the interface thereof. The placement of the circles in the coating deposit are closely controlled to build-up a smooth coating of uniform thickness and to minimize substrate heating and residual stresses in the applied coating.

As a general rule, the powdered coating material used in the thermal spray process will have essentially the same composition as the applied coating itself. With some thermal spray equipment, however, changes in composition may be expected. In such cases, the powder composition will be adjusted accordingly to achieve the desired coating composition.

Although the present invention will be described hereinafter with particular reference to coatings prepared by the plasma arc spray process, it will be understood that any of the known deposition techniques mentioned above or similar techniques can also be employed.

According to the present invention, wear and corrosion resistant coatings are applied to metallic substrates by plasma spraying a mechanically blended powder mixture containing separate components including a first component containing tungsten carbide and a second component containing boron and at least one metal selected from the group consisting of nickel, cobalt and iron. The powder mixture will also include titanium in the first or second component or in a separate third component. The first, second or third component, preferably the second component containing boron, should have a melting point less than about 1200° C. The as-deposited coating is then heat treated at an elevated temperature sufficient to melt this component in the powder mixture. At these temperatures, diffusion and chemical reactions occur between the thin overlapping splat deposited by the thermal spray process, some of which contain the tungsten carbide component with or without titanium, others of which contain the boron-containing alloy component with or without titanium, and still others of which contain titanium when no titanium is employed in either of the first mentioned components. These diffusion and chemical reactions result in the substitution of titanium for tungsten in the carbide phase and reaction between tungsten and boron to form boride precipitates, because the affinity of carbon to titanium is greater than that to tungsten. The titanium carbide particles and tungsten boride precipitates are uniformly dispersed in the metal matrix. Essentially no reaction takes place between the powder particles during deposition so that the splats, before heat treatment, retain their initial powder composition.

The coatings of the present invention may be prepared using a two component system, that is, a first tungsten carbide component and a second boron-containing alloy component with either the first or second component or both containing titanium or alternatively, a multiple component system may be employed. The multiple component system is employed in those cases where titanium is not employed in either one of the first two components. The multiple component system may also be employed in those situations where it is desirable to include additional elements in the metal matrix.

The formation of coatings containing titanium carbide and tungsten boride may proceed according to one of the following equations:

$$(W,Ti)C-M_1+(M_2-B)\rightarrow WM_1'B+TiC+(M_2-M_1'') \quad (1)$$

$$WC-M_1+Ti+(M_2-B)\rightarrow WM_1'B+TiC+(M_2-M_1'') \quad (2)$$

$$WC-M_1+Ti-B+(M_2-B)\rightarrow WM_1'B+TiC+(M_2-M_1'') \quad (3)$$

wherein $M_1$ and $M_2$ are at least one metal selected from the group consisting of nickel, cobalt and iron and optionally any other metal or metal alloy;

B is boron $M_1=M_1'+M_1''$

In addition to the elements mentioned, $M_1$ and $M_2$ may also contain small amounts of other elements such as carbon, oxygen and nitrogen.

The proportion of titanium, tungsten, carbide and boron used in the powder mixture determines the volume fraction of both the titanium carbide and tungsten borides that precipitate in the metal matrix. Generally, the ratio of tungsten to boron should be kept in a range from about 0.4 to about 2.0. The ratio of titanium to carbon is about 1.0.

For optimum wear and corrosion properties, the volume fraction of titanium carbide and tungsten boride precipitates in the coating should be maintained in a range from about 30 to about 80 volume percent. Typically, the volume fraction of the titanium carbide particles will be about 15 to 30 volume percent whereas the volume fraction of the tungsten boride precipitates will be about 30 to 50 volume percent.

It has been found that coatings can be prepared with a volume fraction of tungsten borides in the above ranges if the elements in the boron-containing alloy are kept within the following proportions: from about 3 to about 20 wt. % boron, 0 to about 10 wt. % molybdenum, 0 to about 20 wt. % chromium, 0 to about 5 wt. x manganese, 0 to about 5 wt. % aluminum, 0 to about 1 wt. % carbon, 0 to about 5 wt. % silicon, 0 to about 5 wt. % phosphorus, 0 to about 5 wt. % copper and 0 to about 5 wt. % iron, the balance being nickel, cobalt or iron or combinations thereof.

Most any boron-containing alloy can be used to prepare coatings according to the present invention so long as the alloy satisfies the requirements of the diffusion reaction. Alloys which are particularly suited for use in preparing coatings according to the present invention are given in Table I below.

TABLE I

BORON-CONTAINING ALLOYS

| Alloy No. | Composition (weight %) | | | | | |
|---|---|---|---|---|---|---|
| | Ni | Cr | Si | B | Fe | C |
| 1 | Balance | 13–17 | 3–5 | 2.75–4 | 3–5 | 0.6–0.9 |
| 2 | Balance | 6–8 | 3–5 | 2.5–3.5 | 2–4 | 0.5–Max |
| 3 | Balance | 3–4 | 3–5.4 | 8.8–10.8 | 2–3.5 | 0.32–Max |
| 4 | Balance | 4.5–6 | 2.3–4 | 5.6–7 | 1.5–3.8 | 0.41–Max |
| 5 | Balance | 3.2 | 2.5 | 6 | | |

It will be realized of course that the boron-containing alloy may not be required in those cases where the titanium-containing alloy or compound incorporates boron, e.g. $TiB_2$.

It is important in the practice of the present invention to heat treat the as-deposited coating at a sufficiently elevated temperature for the boron-containing alloy to be fluid enough to promote the diffusion reaction, typically about 1000° C. The heat treatment temperature can be substantially higher than 1000° C. if desired, e.g. about 1200° C., but the temperature should not be so high as to detrimentally affect the substrate. The as-deposited costing should be maintained at heat treatment temperature for times sufficient to promote the reaction and/or diffusion between the components of the coating. A limited, but important, amount of diffusion reaction occurs also with the substrate.

The heat treatment of the coating is generally carried out in a vacuum or an inert gas furnace. Alternatively, the heat treatment can be achieved by surface fusion processes such as electron beam, laser beam, transferred plasma arc, induction heating or other techniques so long as the time at elevated temperature is sufficiently short or a protective atmosphere is provided such that no significant oxidation of the coating occurs.

An advantage of the present invention is that the coatings can be applied with success to many different types of substrates using the known deposition techniques described above or similar techniques. However, the substrate must be able to withstand the effects of heat treatment without any harmful result. Suitable substrate materials which can be coated according to the present invention include, for example, steel, stainless steel, iron base alloys, nickel, nickel base alloys, cobalt, cobalt base alloys, chromium, chromium base alloys, titanium, titanium base alloys, refractory metals and refractory metal base alloys.

Coatings of the present invention are most advantageously applied to substrates of carbon steel, stainless steels, and superalloys (e.g., iron, nickel and/or cobalt base alloys).

The thickness of coatings prepared according to the present invention generally vary from about 0.005 to about 0.040 inch ($1.3\times10^2$ to $1.0\times10^3$ micrometers).

The microstructures of the coatings of the present invention are somewhat complex and not fully understood. However, it is known from studies so far conducted that the coatings contain essentially two separate hard phases comprising ultrafine titanium carbide particles and tungsten boride precipitates dispersed in a metal matrix. The metal matrix is essentially crystalline, relatively dense, softer than either hard phase and has a low permeability.

The size of the titanium carbide particles and tungsten boride precipitates will vary depending upon several factors including the heat treatment temperature and time. However, the average particle size will usually be sub-micron, typically from about 0.5 to about 3.0 microns.

Generally speaking, the hardness of the coatings varies in direct proportion to the volume fraction of the hard phase. It is possible, for example, to tailor the hardness to a particular range of values by varying the atomic ratio of tungsten to boron within the powder mixture. The hardness of the coatings is typically about 800 $DPH_{300}$ (HV.3).

An important advantage of the present invention is that the diffusion reaction between tungsten and the boron-containing alloy takes place at relatively low heat treatment temperatures, e.g., about 1000° C. Although the exact reason for this phenomenon is not understood, it is believed to be due to the build-up of high internal stresses and dislocations inside the lamellar splats or leaves that are deposited onto the substrate by thermal spraying. In contrast, metal borides and carbides are normally formed by conventional casting or hot pressed methods at significantly higher temperatures, i.e., greater than about 1300° C. These higher temperatures are usually detrimental to most steels. Due to the low heat treatment temperatures required in the present coating process, the substrates can now be coated without any harmful effects.

The following examples will serve to further illustrate the practice of the present invention.

EXAMPLE I

Figure 2:
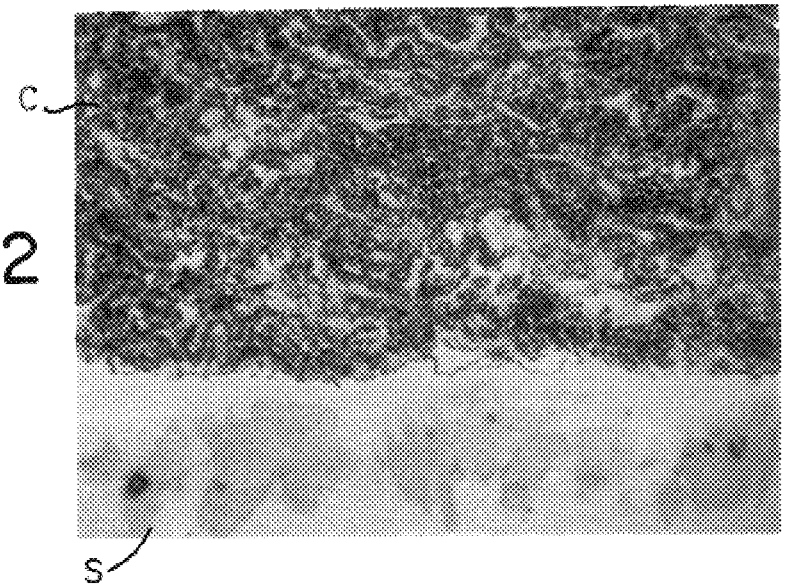
FIG. 2 is a photomicrograph taken at a magnification of 440× showing a heat treated coating according to the present invention.
Figure 3:
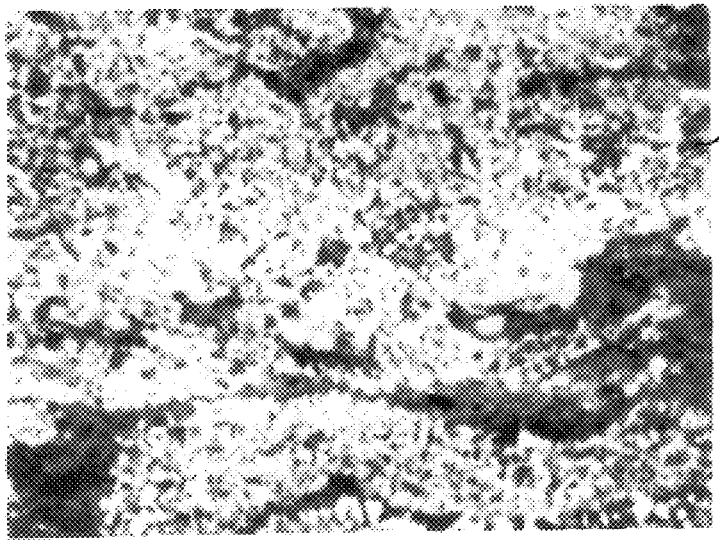
FIG. 3 is a photomicrograph taken at a magnification of 3500× in a scanning electron microscope (SEM) showing in enlarged detail the microstructure of a typical coating according to the present invention.

A number of $TiC/W_2CoB_2$ coatings were prepared by plasma spraying powder mixtures of a tungsten carbide-cobalt alloy, titanium diboride ($TiB_2$) and Alloy No. 2 on AISI 1018[1] steel specimens measuring ¾×½×2¾ inches to a thickness of about 0.020 inch (0.5 mm). The mix formulation was as follows: 50 wt. % (WC-10 Co)+10 wt. % $TiB_2$+40 wt. % Alloy No. 2. The W to B atomic ratio was about 1. A polished cross-section of the as-deposited coating is shown in FIG. 1. The coating has a lamellar structure consisting of irregular shaped splats firmly adhered to one another and to the steel substrate. The splats were formed by impact of WC-Co, $TiB_2$ and Alloy No. 2 powders in the molten or semi-molten condition on the substrate. The as-deposited coating was then heat treated for one hour at a temperature of about 1000 to 1075° C. in vacuum or argon. FIG. 2 shows the coating structure after heat treatment. As shown, the coating consists of a primary coating and an interdiffusion zone formed by diffusion reaction between the coating materials and substrate. The interdiffusion zone was about 50 to 60 micrometers wide with a finger-like iron-boride phase scattered along the diffusion zone/substrate interface. The primary coating contains a great number of fine particles distributed uniformly in a Ni—Cr—Si—Fe matrix. The particles were identified as TiC and $W_2CoB_2$ phases by X-ray diffraction and EDX analyses. The TiC and $W_2CoB_2$ phases were formed by substituting Ti for W in the carbide and reacting W and Co with B during diffusion, and chemical reaction between WC-Co and $TiB_2$ splats, because the affinity of Ti to C is greater than that of W to C. In FIG. 3, a scanning electron micrograph reveals TiC and $W_2CoB_2$ phases with a particle size less than 1 micrometer. The $W_2CoB_2$ phase exhibits a characteristic light contrast, while the TiC phase exhibits a dark contrast dispersed in the matrix.

[1]AISI 1018 steel is a low carbon steel (approx. 0.18 C, balance Fe)

Metallographic examination of the coatings revealed an apparent porosity in the range of 0.5 to 0.75 percent and a hardness ranging from about 700 to 1100 $DPH_{300}$(HV.3).

Abrasive wear properties of the $TiCW_2$ $CoB_2$ coatings prepared above were determined using a standard dry sand/rubber wheel abrasion test described in ASTM Standard G 65-80, Procedure A. In this test, the coated specimens were loaded by means of a lever arm against a rotating wheel with a chlorobutyl rubber rim around the wheel. An abrasive (i.e., 50–70 mesh Ottawa Silica Sand) was introduced between the coating and the rubber wheel. The wheel was rotated in the direction of the abrasive flow. The test specimens were weighed before and after the test and their weight loss was recorded. Because of the wide differences in the densities of the different materials tested, the mass loss is normally converted to volume loss to evaluate the relative ranking of the materials. The average volume loss for these particular coating specimens was about 1.4 $mm^3$/1000 revolutions.

The $TiC/W_2CoB_2$ coatings were also subjected to erosion tests. These tests were conducted according to standard procedures using alumina particles with a nominal size of 27 microns, and a particle velocity of about 91 meters/sec. at two impingement angles of 90° and 30°. The erosion rates were found to be about 128 and 26 micrometers/gm, respectively.

The abrasion and erosion resistance of the coatings were considered to be excellent when compared to other conventional coatings.

Figure 4:
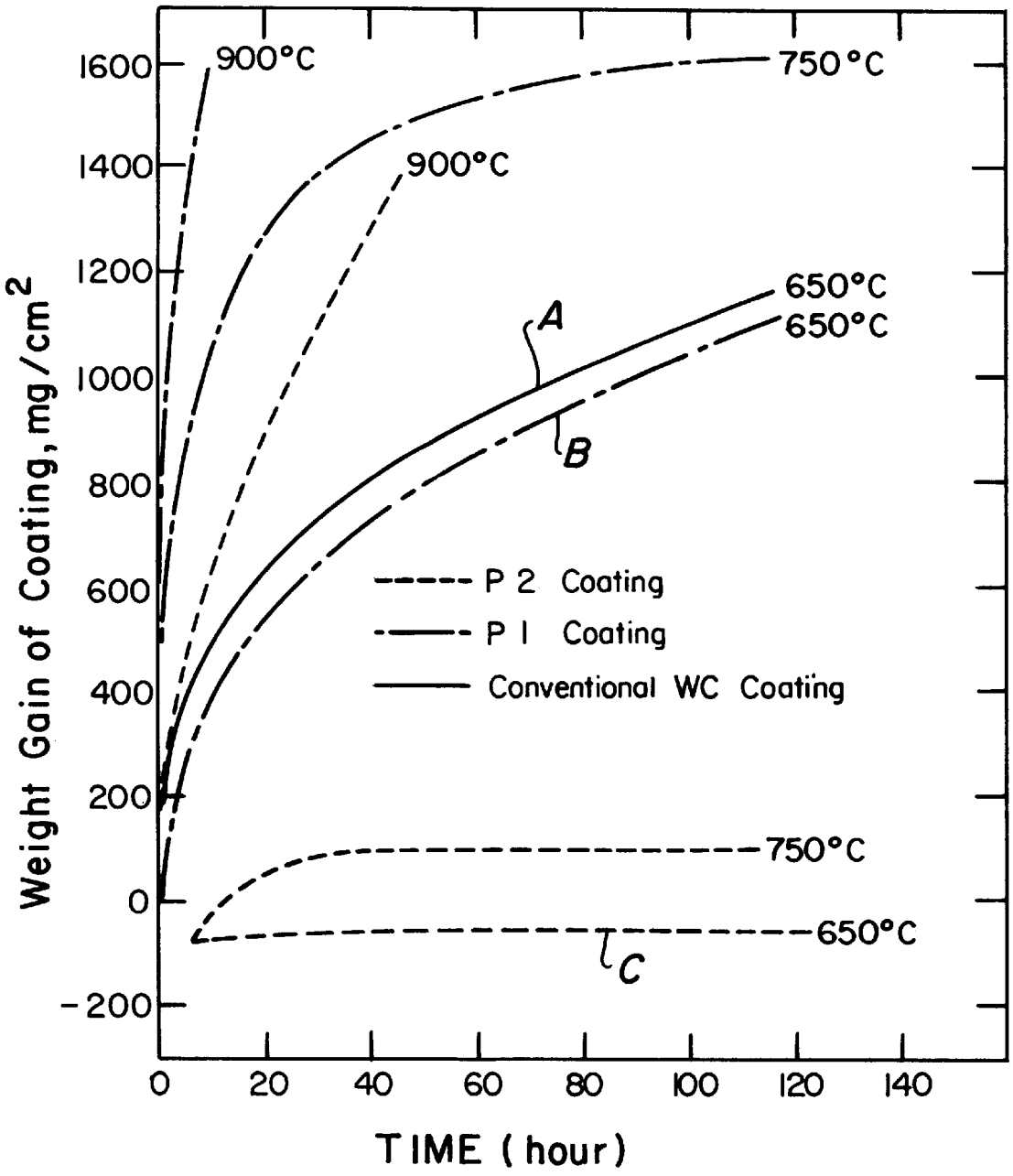
FIG. 4 is a group of curves comparing the weight gain of coatings prepared according to the present invention and conventional coatings when exposed to an oxidizing environment.

In another series of tests, oxidation measurements were made on two $TiC/W_2CoB_2$ coatings of different composition and compared to conventional tungsten carbide based coatings. The amount of oxidation of each sample coating was determined by measuring the weight gain (micrograms/$cm^2$) and the time of exposure to the oxidizing environment. The results of the test are shown in FIG. 4. It will be seen, for example, that the conventional WC coatings exhibited substantial weight gain when heated to temperatures of 650° C. as shown by curve A. A somewhat lower weight gain was exhibited by a $TiC/W_2CoB_2$ coating made from a powder mix formulation P1 comprising 50 wt. % (WC-10 Co)+8 wt. % $TiB_2$+42 wt. % Alloy No. 2 as shown by curve B. However, little weight gain was exhibited by a $TiC/W_2CoB_2$ coating made from a powder mix formulation P2 comprising 50 wt. % (WC-10 Co)+10 wt. % $TiB_2$+40 wt. % Alloy No. 2 as shown by curve C. The latter coating exhibited little weight gain until exposed to temperatures above about 900° C.

EXAMPLE II

A number of TiC/WCoB coatings were prepared by plasma spraying powder mixtures of a tungsten carbide-cobalt alloy, titanium diboride ($TiB_2$), cobalt and Alloy No. 2 onto AISI 1018 steel specimens measuring ¾×½×2¾ inches to a thickness of about 0.020 inch (0.5 mm). Additional cobalt was used in the powder mixture to favor the formation of WCoB rather than $W_2CoB_2$ as in Example I. The mix of formulation was as follows: 50 wt. % (WC-10 Co)+10 wt. % $TiB_2$+20 wt. % Alloy No. 2+20 wt. % Co. The W to B atomic ratio was about 1. The as-deposited coatings were heat reated for one hour at temperatures of about 1050 to 1075° C. in vacuum or argon. After heat treatment, the coatings were cooled and examined. The coatings had a lamellar structure of splats containing TiC and WCoB precipitates dispersed in a Ni—Cr—Si—Fe matrix. The size of the precipitates was less than about 1 micron.

The hardness of these TiC/WCoB coatings was in the range of 700 to 1100 $DPH_{3000}$(HV.3).

Abrasive wear and erosion properties of the coatings were determined using the same test procedures described in Example I. The sand abrasion wear rate of these coatings was about 1.9 $mm^3$/1000 revolutions. The erosion wear rate to alumina particles at 30° and 90° impingement angles were found to be approximately 30 and 130 micrometers per gram, respectively. The abrasion and erosion properties of these coatings were considered to be good to excellent.

EXAMPLE III

A number TiC-rich $TiC/W_2NiB_2/WC/WC_2$ coatings were prepared by plasma spraying powder mixtures of tungsten—titanium carbide-nickel alloy and Alloy No. 5 onto AISI 1018 steel specimens measuring ¾×½×2¾ inches to a thickness of about 0.020 inch (0.5 mm). The mix formulation was as follows: 60 wt. % (W, Ti) C–Ni+40 wt. % Alloy No. 5. The as-deposited coatings were heat treated for one hour at a temperature of about 1045° C. in vacuum or argon and then cooled. The coatings had a lamellar structure of fine precipitates of TiC and $W_2NiB_2$ dispersed between WC or $WC_2$ particles in a Ni—Cr—Si—Fe matrix.

The hardness of these coatings was about 900 $DPH_{300}$ (HV.3).

Abrasive wear properties of the coating were also determined using the standard dry sand/rubber wheel test described in Example I. The average wear rate was found to be 1.3 $mm^3$/1000 revolutions. The erosion wear rate to alumina particles (feed rate of 1.2 gm/min, velocity=91 m/sec) at 30° and 90° was 30 and 126 micrometers/gm. The erosion properties of this coating were also considered to be very good to excellent.

I claim:

1. A wear and corrosion resistant coating on a substrate, said coating comprising hard, ultrafine, titanium carbide particles and tungsten boride precipitates dispersed in a metal matrix, the two phases constituting from about 30 to about 80 volume percent of the coating, the balance being metal matrix.

2. A coating according to claim 1 wherein the titanium carbide particles constitute about 15 to 30 volume percent of the coating.

3. A coating according to claim 1 wherein the tungsten boride precipitates constitute about 30 to 50 volume percent of the coating.

4. A coating according to claim 1 wherein the atomic ratio of tungsten to boron in said coating is between about 0.4 and 2.0.

5. A coating according to claim 1 wherein the atomic ratio of titanium to carbon is about 1.0.

6. A coating according to claim 1 wherein the average size of said titanium carbide particles and tungsten boride precipitates ranges from about 0.5 to about 3.0 microns.

7. A coating according to claim 1 having a hardness of about 700 to 1200 $DPH_{300}$ (HV.3).

8. A coating according to claim 1 wherein the metal matrix is composed of at least one metal selected from the group consisting of nickel, cobalt and iron.

9. A coating according to claim 1 having a thickness within the range of from about 0.005 to about 0.040 inch.

10. A coating according to claim 1 wherein the substrate is a material selected from the group consisting of steel, stainless steel, iron base alloys, nickel, nickel base alloys, cobalt, cobalt base alloys, chromium, chromium base alloys, titanium, titanium base alloys, refractory metals and refractory metal base alloys.

11. A coating according to claim 10 wherein the substrate is a steel.

12. A coating according to claim 10 wherein the substrate is a superalloy.

13. A coating according to claim 1 wherein the tungsten-boride precipitates comprise $W_2CoB_2$.

14. A coating according to claim 1 wherein the tungsten-boride precipitates comprise $W_2NiB_2$.

15. A coating according to claim 13 wherein the tungsten-boride precipitates comprise WCoB.

16. An article comprising a substrate and a coating applied to said substrate, said coating comprising hard, ultrafine, titanium carbide particles and tungsten boride precipitates dispersed in a metal matrix, the two phases constituting from about 30 to about 80 volume percent of the coating, the balance being metal matrix.

* * * * *

UNITED STATES PATENT AND TRADEMARK OFFICE

CERTIFICATE OF CORRECTION

PATENT NO. : 5,966,585
DATED : October 12, 1999
INVENTOR(S) : Sue

It is certified that error appears in the above-identified patent and that said Letters Patent is hereby corrected as shown below:

Title page,
Item [73], Assignee, delete "Union Carbide Coatings Service Corporation" and insert: -- Praxair S.T. Technology, Inc., North Haven, CO --

Signed and Sealed this

Fifteenth Day of October, 2002

*Attest:*

*Attesting Officer*

JAMES E. ROGAN
*Director of the United States Patent and Trademark Office*